US007786674B2

(12) United States Patent
Tu

(10) Patent No.: US 7,786,674 B2
(45) Date of Patent: Aug. 31, 2010

(54) QUARTZ METAL HALIDE LAMP WITH IMPROVED LUMEN MAINTENANCE

(75) Inventor: Junming Tu, Bath, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 574 days.

(21) Appl. No.: 11/718,423

(22) PCT Filed: Nov. 2, 2005

(86) PCT No.: PCT/IB2005/053577

§ 371 (c)(1),
(2), (4) Date: May 2, 2007

(87) PCT Pub. No.: WO2006/048830

PCT Pub. Date: May 11, 2006

(65) Prior Publication Data

US 2008/0093993 A1 Apr. 24, 2008

Related U.S. Application Data

(60) Provisional application No. 60/624,795, filed on Nov. 3, 2004.

(51) Int. Cl.
*H01J 17/20* (2006.01)

(52) U.S. Cl. ..... 313/641; 313/637

(58) Field of Classification Search ..... 313/637–641, 313/25

See application file for complete search history.

(56) References Cited

U.S. PATENT DOCUMENTS

| | | | | |
|---|---|---|---|---|
| 5,471,110 | A * | 11/1995 | van der Leeuw et al. | 313/25 |
| 5,973,543 | A | 10/1999 | Shimura | |
| 6,525,476 | B1 | 2/2003 | Geijtenbeek et al. | |
| 6,756,721 | B2 | 6/2004 | Higashi et al. | |
| 2002/0027421 | A1 | 3/2002 | Kaneko et al. | |

FOREIGN PATENT DOCUMENTS

| | | |
|---|---|---|
| EP | 1134776 A2 | 9/2001 |
| JP | 54102070 | 8/1979 |

* cited by examiner

*Primary Examiner*—Nimeshkumar D Patel
*Assistant Examiner*—Mary Ellen Bowman

(57) ABSTRACT

A quartz metal halide lamp includes an outer sealed envelope defining an interior space, and an arc tube disposed in the interior space. The arc tube has a fill space. A chemical fill is disposed in the fill space. The chemical fill includes sodium halide and lanthanide halide, with the lanthanide halide selected from the group consisting of europium iodide, europium bromide, praseodymium iodide, praseodymium bromide, ytterbium iodide, ytterbium bromide and combinations thereof. The lanthanide halide is between 2 and 6 weight percent of the chemical fill. Electrodes are partially disposed within the fill space.

22 Claims, 2 Drawing Sheets

QUARTZ METAL HALIDE LAMP WITH IMPROVED LUMEN MAINTENANCE

CROSS REFERENCE TO RELATED APPLICATION

This application claims the benefit of U.S. provisional application Ser. No. 60/624,795, filed Nov. 3, 2004, the entire subject matter of which is hereby incorporated by reference.

The present invention relates generally to quartz metal halide lamps, and more specifically to quartz metal halide lamps with improved lumen maintenance.

Quartz metal halide lamps with sodium and scandium chemistry provide efficient white light and long life, which has made them the lamps of choice in the industrial, retail and outdoor lighting market. However, the lumen maintenance of these lamps needs improvement. The lumen output declines with lamp life, requiring more lamps or early replacement. As the quartz metal halide lamps age, the high temperature in the arc tube causes the tungsten from the electrodes to evaporate onto the walls of the discharge vessel or arc tube, thereby blackening the walls. This high-temperature induced electrode erosion is an important aging factor for the quartz halide lamps.

Lumen maintenance for quartz metal halide lamps is defined as the ratio, in percent, of the light output after Y hours of operation to the light output of the lamp after one hundred (100) hours of operation. Quartz metal halide lamps are rated for mean lumen maintenance of X % at Y hours. Typical end of life ratings for commercially available quartz metal halide lamps are between 60% and 40% of the rated light.

It would be desirable to provide a quartz metal halide lamp with improved the lumen maintenance.

One aspect of the present invention provides a quartz metal halide lamp including an outer sealed envelope defining an interior space and an arc tube disposed in the interior space, the arc tube having a fill space. A chemical fill is disposed in the fill space. The chemical fill includes sodium halide and lanthanide halide and the lanthanide halide is selected from the group consisting of europium iodide, europium bromide, praseodymium iodide, praseodymium bromide, ytterbium iodide, ytterbium bromide and combinations thereof. The lanthanide halide is between 2 and 6 weight percent of the chemical fill. Electrodes are partially disposed within the fill space.

A second aspect of the present invention provides a quartz metal halide lamp including an outer sealed envelope defining an interior space, and an arc tube disposed in the interior space. The arc tube has a fill space and a chemical fill disposed in the fill space. The chemical fill includes mercury, sodium halide, lanthanide halide, and scandium halide. A start-up rare gas is disposed in the fill space, and electrodes are positioned in the arc tube in contact with the start-up rare gas. The lanthanide halide is selected from the group consisting of cerium iodide, cerium bromide, europium iodide, europium bromide, praseodymium iodide, praseodymium bromide, ytterbium iodide, ytterbium bromide and combinations thereof, and the sodium halide is greater than 77 weight percent of the chemical fill.

A third aspect of the present invention provides a quartz metal halide lamp including an outer sealed envelope defining an interior space and an arc tube disposed in the interior space. The arc tube has a fill space with a chemical fill and a start-up rare gas disposed in the fill space. Electrodes are positioned in the arc tube in contact with the start-up rare gas. The chemical fill includes mercury, sodium halide, lanthanide halide, indium halide, and thallium halide. The lanthanide halide is selected from the group consisting of cerium iodide, cerium bromide, europium iodide, europium bromide, praseodymium iodide, praseodymium bromide, ytterbium iodide, ytterbium bromide and combinations thereof, and the lanthanide halide is between 2 and 6 weight percent of the chemical fill.

The foregoing form as well as other forms, features and advantages of the present invention will become further apparent from the following detailed description of the presently preferred embodiments, read in conjunction with the accompanying drawings. The detailed description and drawings are merely illustrative of the present invention rather than limiting, the scope of the present invention being defined by the appended claims and equivalents thereof.

Figure 1:
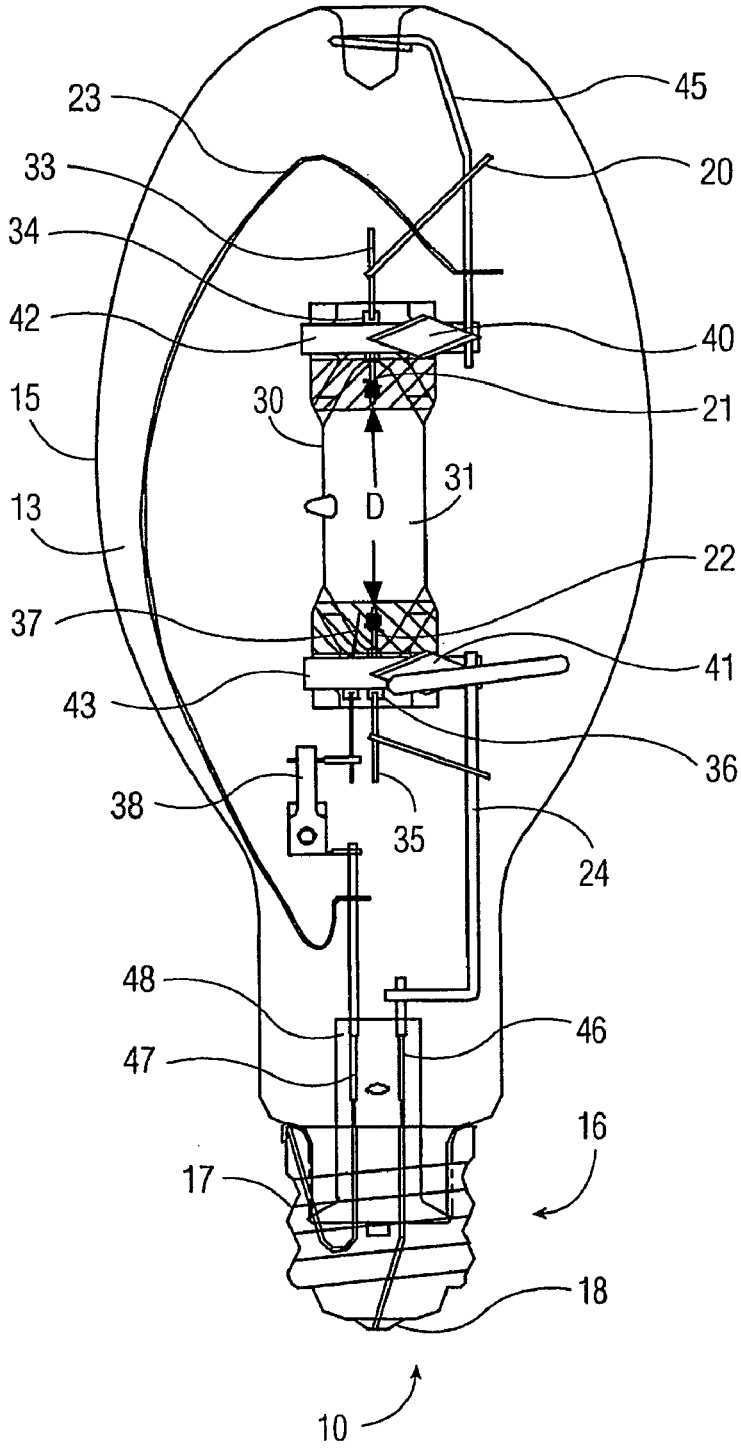
FIG. 1 is a front view of a quartz metal halide lamp made in accordance with the present invention.

FIG. 1 is a front view of a quartz metal halide lamp made in accordance with the present invention. The quartz metal halide lamp 10 includes an outer sealed envelope 15 defining an interior space 13, a discharge vessel or an arc tube 30 being disposed in the interior space 13 and having a fill space 31. The arc tube 30 is a cylinder enclosing a fill space 31. A chemical fill is disposed in the fill space 31 of the arc tube 30 and electrodes 21 and 22 are partially disposed within the fill space 31 at opposite ends of the closed arc tube 30. The electrode 21 and electrode 22 are held in position by the closed ends of the arc tube 30 with a predetermined gap D and are operable to generate an arc within the arc tube 30.

The chemical fill is placed into the fill space 31 of the arc tube 30 and a start-up rare gas fills any fill space 31 not occupied by the chemical fill. As the electrode 21 and electrode 22 are held in position with the predetermined gap D, the ends of the arc tube 30 are hermetically sealed to enclose the chemical fill and the start-up rare gas within the fill space 31.

Electrode 21 is connected to current lead-through 33 and 34. Electrode 22 is connected to current lead-through 35 and 36. An auxiliary starting probe 37 and a switch 38 are provided to facilitate lamp start-up. Two getters 40 and 41 absorb gas impurities within the outer sealed envelope 15. The arc tube 30 is mounted on a frame including metal straps 42 and 43. Current conductor 45 is connected to current lead-through 33 and 34 through current conductor 20. The wire 23, current conductors 24, 45, 46 and 47, stem 48, and arc tube 30 are accommodated in the outer sealed envelope 15 and provide the structure to locate the arc tube 30 within the interior space 13. In one embodiment, a vacuum exists in the interior space 13 between the arc tube 30 and the outer sealed envelope 15. In an alternative embodiment, nitrogen in a pressure range of 0.1 atmosphere to 0.7 atmosphere is present in the interior space 13 between the arc tube 30 and the outer sealed envelope 15. The current conductors 46 and 47 are connected to the lamp cap 16. The current conductor 47 is connected to the cap shell 17, and the conductor 46 is connected to the cap eyelet 18.

An alternating current (AC) is supplied to the lamp cap 16 and flows to the electrodes 21, 22 to generate an arc between the electrodes 21, 22. The arc between the electrodes 21, 22 ionizes the atoms and molecules of the start-up rare gas, so that the chemical fill is vaporized and becomes emissive. Thus, the quartz metal halide lamp 10 produces light when the electric current flow generates an arc within the arc tube 30.

Typically, the arc tube 30 is made of fused quartz, and electrodes 21, 22 are made of tungsten. In one embodiment, electrode 21 and electrode 22 are made from thoriated tungsten in which thorium is included in the tungsten electrode. In one embodiment, the outer sealed envelope 15 is made of vitreous glass material. In one embodiment, the rated power of the quartz metal halide lamp 10 is greater than or equal to 25 Watts and less than or equal to 2000 Watts.

The illustrated configuration is exemplary and is not intended to limit the scope of the present invention. The benefits and advantages of the present invention can be realized for any quartz metal halide lamp 10 configuration when the chemical fill as described below is enclosed within the arc tube 30.

The chemical fill disposed in the arc tube 30 includes at least one sodium halide, and at least one lanthanide halide having a weight percentage between 2 wt % and 6 wt % of the chemical fill. Mercury is included in the chemical fill. A start-up rare gas is also disposed in the arc tube 30. The start-up rare gas can be selected from the group of Ar, Xe, Ne, and Kr.

In one embodiment, the chemical fill disposed in the arc tube 30 includes at least one lanthanide halide having a weight percentage between 2 wt % and 6 wt % of the chemical fill, in combination with sodium halide, scandium halide, indium halide, thallium halide and combinations thereof. In one embodiment, the lanthanide halide is selected from the group of cerium iodide ($CeI_3$) and cerium bromide ($CeBr_3$), europium iodide ($EuI_3$), europium bromide ($EuBr_3$), praseodymium iodide ($PrI_3$), praseodymium bromide ($PrBr_3$), ytterbium iodide ($YbI_3$), ytterbium bromide ($YbBr_3$), and combinations thereof. In one embodiment, the lanthanide halide has a weight percentage between 3 wt % and 5 wt %.

The lanthanide halide reduces the temperature of the electrodes 21, 22. The work function is a quantity with dimensions of energy, which determines the thermionic emission of a solid at a given temperature. The work functions of cerium, europium, ytterbium, and praseodymium are low, reducing the temperature of the electrodes 21, 22. This results in reduced evaporation of tungsten from the electrodes 21, 22 and reduced wall blackening, improving lumen maintenance. The work function of cerium, europium, ytterbium, and praseodymium are 2.7 eV, 2.54 eV, 2.59 eV, and 2.8 eV, respectively.

For embodiments in which the electrodes 21, 22 are thoriated tungsten electrodes, the chemical fill can further include thorium iodide ($ThI_4$). In one embodiment, the $ThI_4$ has a weight percentage between 1 wt % and 4 wt % of the chemical fill. In another embodiment, the $ThI_4$ has a weight percentage between 2 wt % and 3 wt %.

Long-term life test experiments were carried out to evaluate the lumen maintenance factor of quartz metal halide lamps with thoriated tungsten electrodes having a chemical fill including $CeI_3$ mixed with NaI—$ScI_3$. The test lamp 1 had 2% thoriated tungsten electrodes and a chemical fill of 3 wt % $CeI_3$ mixed with NaI—$ScI_3$. In molar percent, test lamp 1 had a chemical fill including 93.8 molar % of NaI, 5.0 molar % of $ScI_3$, and 1.2 molar % of $CeI_3$. The test lamp 2 had 1% thoriated tungsten electrodes and a chemical fill of 2.4 wt % $CeI_3$ mixed with NaI—$ScI_3$. In molar percent, test lamp 2 had a chemical fill including 95.7 molar % of NaI, 3.5 molar % of $ScI_3$, and 0.8 molar % of $CeI_3$. Table 1 shows details of the chemical fill for the test lamps and the reference lamps. The quartz metal halide test lamps in which $CeI_3$ was included in the chemical fill also had a small amount of scandium added to the chemical fill. A sufficient mercury dose was added to the chemical fill to sustain the arc within the arc tube 30 after the start-up rare gas is ionized. The test lamps and reference lamps all had an argon start-up rare gas.

TABLE 1

| Lamp | # of lamps | Electrode | NaI—$Sc_3$ Pellet | $CeI_3$ wt % | Hg dose | Argon fill atm |
|---|---|---|---|---|---|---|
| Test 1 | 4 | Th—W, 2% | 16 mg | 3 wt % | 29 mg | 0.059 |
| Reference 1 | 5 | Th—W, 2% | 16 mg | 0 | 29 mg | 0.059 |
| Test 2 | 5 | Th—W, 1% | 20 mg | 2.4 wt % | 32 mg | 0.046 |
| Reference 2 | 5 | Th—W, 1% | 20 mg | 0 | 32 mg | 0.046 |

The test lamps and reference lamps were configures as shown in FIG. 1. All the lamps were aged in the vertical base-up position on a constant wattage auto-transformer ballast. Light output was measured with a photometer at various test intervals. The photometer measurements provided the correlated color temperature, the efficacy in lumens/Watt, and other parameters related to the light output of the quartz metal halide test lamps and reference lamps.

Figure 2:
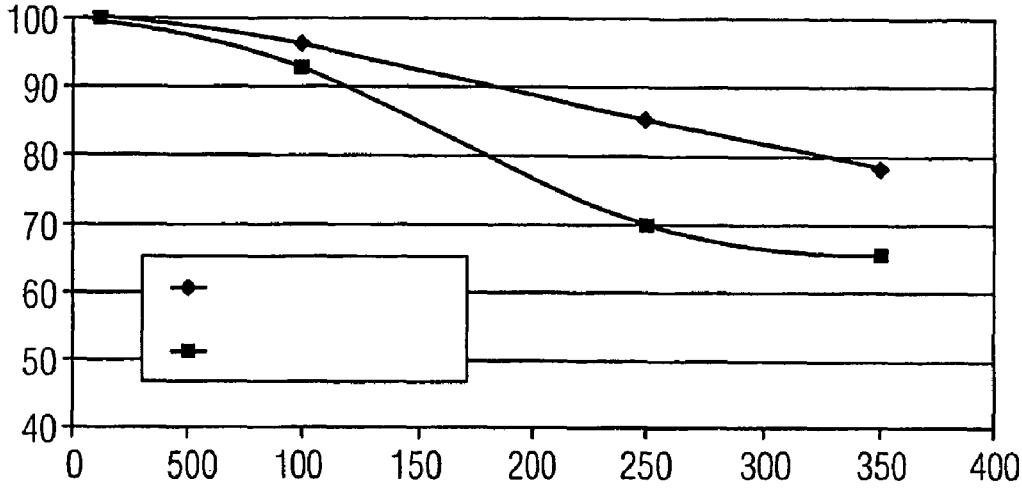
FIG. 2 is a graph of changes in average lumen maintenance of the quartz metal halide lamp of a first embodiment of the present invention with respect to a conventional quartz metal halide lamp.

FIG. 2 is a graph of changes in the average lumen maintenance of the quartz metal halide lamp of a first embodiment of the present invention with respect to the conventional quartz metal halide lamp. As shown in FIG. 2, the four lamps of Test 1 with NaI—$ScI_3$ and 3 wt % $CeI_3$ (Row 1 of Table 1) had higher-average lumen maintenance than the lamps of Reference 1 (Row 2 of Table 1). After 3500 hours of operation, the lamps of Test 1 with NaI—$ScI_3$ and 3 wt % $CeI_3$ had lumen maintenance of 82.4 wt %. This was 14% higher than the 68.4% lumen maintenance of the lamps of Reference 1 at 3500 hours. The lamps of Test 1 with NaI—$ScI_3$ and 3 wt % $CeI_3$ had a shorter glow-to-arc transition measurement after 100 hours of operation than the lamps of Reference 1. The light output and the color properties of the light output at 100 hours were the similar for the lamps of Test 1 and the lamps of Reference 1. The lamp voltage rise and color shift over time were similar for the lamps of Test 1 and the lamps of Reference 1.

Figure 3:
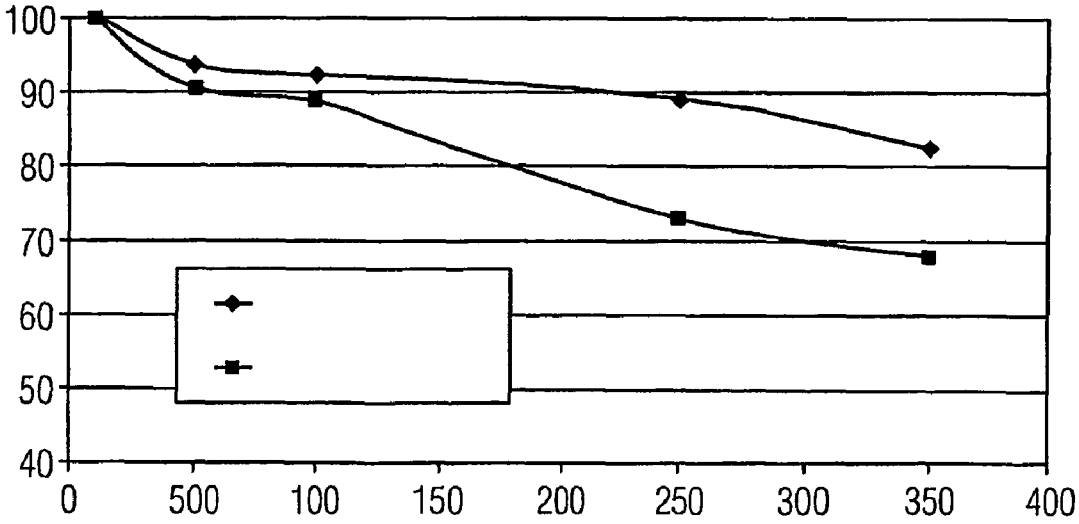
FIG. 3 is a graph of changes in average lumen maintenance of the quartz metal halide lamp of a second embodiment of the present invention, with respect to a conventional quartz metal halide lamp.

FIG. 3 is a graph of changes in the average lumen maintenance of the quartz metal halide lamp of a second embodiment of the present invention with respect to a conventional quartz metal halide lamp. As shown in FIG. 3, the five lamps of Test 2 with NaI—$ScI_3$ and 2.4 wt % $CeI_3$ (Row 3 of Table 1) had higher average lumen maintenance than the lamps of Reference 2 (Row 4 of Table 1). After 3500 hours of operation, the lamps of Test 2 with NaI—$ScI_3$ and 2.4 wt % $CeI_3$ had lumen maintenance of 78.2%. This was 12.8% higher than the 65.4% lumen maintenance of the lamps of Reference 2 at 3500 hours. The lamps of Test 2 with NaI—$ScI_3$ and 2.4 wt % $CeI_3$ had a shorter glow-to-arc transition measurement after 100 hours of operation than the lamps of Reference 2. The light output and the color properties of the output light at 100 hours were the similar for the lamps of Test 2 and the lamps of Reference 2. The lamp voltage rise and color shift over time were similar for the lamps of Test 2 and lamps of Reference 2.

These experiments demonstrate that the lumen maintenance of quartz metal halide lamps 10 is improved by including 2 wt % to 6 wt % $CeI_3$ in the chemical fill. Those skilled in the art will appreciate that a similar improvement in lumen maintenance can be obtained with the chemical fill embodiments described below, for both thoriated and non-thoriated tungsten electrodes 21, 22. In the embodiments described below, the sodium, lanthanide, scandium, lithium, indium and thallium halides can be used in various combinations of compounds and elements within the chemical groups.

In one embodiment, lumen maintenance of quartz metal halide lamps 10 having thoriated tungsten electrodes 21, 22 is improved with the inclusion of 2 wt % to 6 wt % $CeI_3$ in the chemical fill of NaI—$ScI_3$ in which the sodium halide is greater than 75 wt % of the chemical fill. The addition of 2 wt % to 6 wt % $CeI_3$ to the chemical fill of NaI—$ScI_3$ in which the sodium halide is greater than 75 wt % of the chemical fill also improves lumen maintenance of quartz metal halide lamps 10 having non-thoriated tungsten electrodes 21, 22. In an alternative embodiment, the 2 wt % to 6 wt % $CeI_3$ is replaced with 2 wt % to 6 wt % of one or more of $CeI_3$, $EuI_3$, $EuBr_3$, $PrI_3$, $PrBr_3$, $YbI_3$, and/or $YbBr_3$.

In one embodiment, the chemical fill includes sodium halide and lanthanide halide. The lanthanide halide is one or more of $EuI_3$, $EuBr_3$, $PrI_3$, $PrBr_3$, $YbI_3$, and/or $YbBr_3$, and is between 2 wt % to 6 wt % of the chemical fill. In another embodiment, the chemical fill includes sodium halide and lanthanide halide. The lanthanide halide is one or more of $EuI_3$, $EuBr_3$, $PrI_3$, $PrBr_3$, $YbI_3$, and/or $YbBr_3$, and is between 3 wt % to 5 wt % of the chemical fill.

In one embodiment, the chemical fill includes a sodium halide and a lanthanide halide of one or more of $CeI_3$, $EuI_3$, $EuBr_3$, $PrI_3$, $PrBr_3$, $YbI_3$, and/or $YbBr_3$. The lanthanide halide is 2 wt % to 5.4 wt % of the chemical fill. In one embodiment, the chemical fill includes a sodium halide and a lanthanide halide of one or more of $CeBr_3$, $EuI_3$, $EuBr_3$; $PrI_3$, $PrBr_3$, $YbI_3$, and/or $YbBr_3$. The lanthanide halide is between 2 wt % and 4 wt % of the chemical fill. In another embodiment, the chemical fill includes a sodium halide and a lanthanide halide of one or more of $CeBr_3$, $EuI_3$, $EuBr_3$, $PrI_3$, $PrBr_3$, $YbI_3$, and/or $YbBr_3$. The lanthanide halide is between 2 and 6 wt % of the chemical fill, and the sodium halide is greater than 77 wt % of the chemical fill.

In one embodiment, 2 wt % to 6 wt % of one or more of $EuI_3$, $EuBr_3$, $PrI_3$, $PrBr_3$, $YbI_3$, and/or $YbBr_3$ is added to a chemical fill that includes a sodium halide and a scandium halide. In another embodiment, 2 wt % to 6 wt % of one or more of $EuI_3$, $EuBr_3$, $PrI_3$, $PrBr_3$, $YbI_3$, and/or $YbBr_3$ is added to a chemical fill that includes a sodium halide, a scandium halide, and a lithium halide. In yet another embodiment, the chemical fill includes a sodium halide, a scandium halide, and a lithium halide (NaI—$ScI_3$—LiI).

In one embodiment, 2 wt % to 6 wt % of one or more of $EuI_3$, $EuBr_3$, $PrI_3$, $PrBr_3$, $YbI_3$, and/or $YbBr_3$ is added to a chemical fill including a sodium halide, an indium halide, and a thallium halide.

In one embodiment, the chemical fill includes a sodium halide that is greater than 77 wt % of the chemical fill, as well as mercury, a scandium halide and one or more of $CeI_3$, $CeBr_3$, $EuI_3$, $EuBr_3$, $PrI_3$, $PrBr_3$, $YbI_3$, and/or $YbBr_3$. In one embodiment, the chemical fill includes a sodium halide that is greater than 77 wt % of the chemical fill, as well as mercury, a scandium halide, a lithium halide and one or more of $CeI_3$, $CeBr_3$, $EuI_3$, $EuBr_3$, $PrI_3$, $PrBr_3$, $YbI_3$, and/or $YbBr_3$.

In one embodiment, the chemical fill includes mercury, a sodium halide, an indium halide, and a thallium halide, as well as one or more lanthanide halide selected from $CeI_3$, $CeBr_3$, $EuI_3$, $EuBr_3$, $PrI_3$, $PrBr_3$, $YbI_3$, and $YbBr_3$. In this embodiment, the lanthanide halide is between 2 and 6 wt % of the chemical fill. In one embodiment, the chemical fill includes a sodium halide, an indium halide, and a thallium halide (NaI—In—I—TlI).

In one embodiment, 3 wt % to 5 wt % of one or more of $CeI_3$, $CeBr_3$, $EuI_3$, $EuBr_3$, $PrI_3$, $PrBr_3$, $YbI_3$, and/or $YbBr_3$ is added to a chemical fill that includes a sodium halide, an indium halide, and a thallium halide.

Those skilled in the art will appreciate that additional elements and compounds can be added to the chemical fill to produce a desired result. From 1 wt % to 4 wt % $ThI_4$ can be added to any of the above mentioned chemical fills to assure enough thorium is present over thousands of hours of lamp operating lifetime. In one embodiment, 1 wt %-4 wt % of $ThI_4$ is added to the above mentioned chemical fills only if the electrodes 21, 22 are thoriated tungsten electrodes. Mercury can also be added to the above mentioned chemical fills to assist in the startup of the quartz metal halide lamp 10.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

The invention claimed is:

1. A quartz metal halide lamp comprising:

an outer sealed envelope defining an interior space;

an arc tube disposed in the interior space, the arc tube having a fill space;

a chemical fill disposed in the fill space, the chemical fill including sodium halide and lanthanide halide; and electrodes partially disposed within the fill space;

wherein the lanthanide halide is selected from the group consisting of europium iodide, europium bromide, praseodymium iodide, praseodymium bromide, ytterbium iodide, ytterbium bromide and combinations thereof, and wherein the lanthanide halide is between 2 and 6 weight percent of the chemical fill.

2. The quartz metal halide lamp of claim 1, wherein cerium iodide is one of the lanthanide halide group, and wherein the lanthanide halide is between 2 and 5.4 weight percent of the chemical fill.

3. The quartz metal halide lamp of claim 1, wherein cerium iodide is one of the lanthanide halide group, and wherein the lanthanide halide is between 2 and 6 weight percent of the chemical fill and the sodium halide is greater than 75 weight percent of the chemical fill.

4. The quartz metal halide lamp of claim 1, wherein cerium bromide is one of the lanthanide halide group, and wherein the lanthanide halide is between 2 and 4.0 weight percent of the chemical fill.

5. The quartz metal halide lamp of claim 1, wherein cerium bromide is one of the lanthanide halide group, and wherein the lanthanide halide is between 2 and 6 weight percent of the chemical fill and the sodium halide is greater than 77 weight percent of the chemical fill.

6. The quartz metal halide lamp of claim 1, wherein the chemical fill further includes scandium halide.

7. The quartz metal halide lamp of claim 1, wherein the chemical fill further includes scandium halide and lithium halide.

8. The quartz metal halide lamp of claim 1, wherein the chemical fill further includes indium halide and thallium halide.

9. The quartz metal halide lamp of claim 1, wherein the electrodes are thoriated tungsten electrodes and the chemical fill further includes thorium iodide.

10. The quartz metal halide lamp of claim 9, wherein the thorium iodide is between 1 and 4 weight percent of the chemical fill.

11. The quartz metal halide lamp of claim 1, wherein the chemical fill further includes mercury.

12. The quartz metal halide lamp of claim 1, further comprising a start-up rare gas disposed within the fill space in contact with the electrodes.

13. The quartz metal halide lamp of claim 12, wherein the start-up rare gas is selected from the group consisting of Ar, Xe, Ne, and Kr.

14. The quartz metal halide lamp of claim 1, wherein the lanthanide halide is between 3 and 5 weight percent of the chemical fill.

15. The quartz metal halide lamp of claim 1, wherein a rated power of the quartz metal halide lamp is greater than or equal to 25 Watts and less than or equal to 2000 Watts.

16. A quartz metal halide lamp comprising:

an outer sealed envelope defining an interior space;

an arc tube disposed in the interior space, the arc tube having a fill space;

a chemical fill disposed in the fill space, the chemical fill including mercury, sodium halide, lanthanide halide, and scandium halide;

a start-up rare gas disposed in the fill space, and electrodes positioned in the arc tube in contact with the start-up rare gas;

wherein the lanthanide halide is selected from the group consisting of cerium iodide, cerium bromide, europium iodide, europium bromide, praseodymium iodide, praseodymium bromide, ytterbium iodide, ytterbium bromide and combinations thereof, the sodium halide is greater than 77 weight percent of the chemical fill, and the lanthanide halide is between 2 and 6 weight percent of the chemical fill.

17. The quartz halide lamp of clam 16, wherein the chemical fill further includes lithium halide.

18. The quartz metal halide lamp of claim 16, wherein the electrodes are thoriated tungsten electrodes and the chemical fill further includes thorium iodide.

19. The quartz metal halide lamp of claim 18, wherein the thorium iodide is between 1 and 4 weight percent of the chemical fill.

20. A quartz metal halide lamp comprising:

an outer sealed envelope defining an interior space;

an arc tube disposed in the interior space, the arc tube having a fill space;

a chemical fill disposed in the fill space, the chemical fill including mercury, sodium halide, lanthanide halide, indium halide, and thallium halide;

a start-up rare gas disposed in the fill space, and electrodes positioned in the arc tube in contact with the start-up rare gas;

wherein the lanthanide halide is selected from the group consisting of cerium iodide, cerium bromide, europium iodide, europium bromide, praseodymium iodide, praseodymium bromide, ytterbium iodide, ytterbium bromide and combinations thereof, and the lanthanide halide is between 2 and 6 weight percent of the chemical fill.

21. The quartz metal halide lamp of claim 20, wherein the electrodes are thoriated tungsten electrodes and the chemical fill further includes thorium iodide.

22. The quartz metal halide lamp of claim 21, wherein the thorium iodide is between 1 and 4 weight percent of the chemical fill.

* * * * *